US009965923B2

(12) United States Patent
Nakamura et al.

(10) Patent No.: US 9,965,923 B2
(45) Date of Patent: May 8, 2018

(54) GAME MACHINE, CONTROL METHOD FOR USE IN THE GAME MACHINE, AND COMPUTER PROGRAM

(75) Inventors: Daisuke Nakamura, Zama (JP); Kenji Nagata, Zama (JP)

(73) Assignee: KONAMI GAMING, INCORPORATED, Las Vegas, NV (US)

( * ) Notice: Subject to any disclaimer, the term of this patent is extended or adjusted under 35 U.S.C. 154(b) by 944 days.

(21) Appl. No.: 14/342,770

(22) PCT Filed: Aug. 30, 2012

(86) PCT No.: PCT/US2012/053008

§ 371 (c)(1),
(2), (4) Date: Mar. 4, 2014

(87) PCT Pub. No.: WO2013/036423

PCT Pub. Date: Mar. 14, 2013

(65) Prior Publication Data

US 2014/0206427 A1 Jul. 24, 2014

(30) Foreign Application Priority Data

Sep. 7, 2011 (AU) ..... 2011221364

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/329* (2013.01); *G07F 17/323* (2013.01); *G07F 17/3244* (2013.01); *G07F 17/3297* (2013.01); *G07F 17/34* (2013.01)

(58) Field of Classification Search

CPC .... G07F 17/32; G07F 17/3297; G07F 17/329; G07F 17/3244; G07F 17/34

(Continued)

(56) References Cited

U.S. PATENT DOCUMENTS 5,951,009 A * 9/1999 Miyamoto ..... A63F 7/045 273/121 B 7,862,419 B2 1/2011 Baerlocher et al.

(Continued)

FOREIGN PATENT DOCUMENTS

CN 1473062 A 2/2004
CN 101490727 A 7/2009

(Continued)

OTHER PUBLICATIONS

Japanese Office Action dispatched Oct. 9, 2015 for CN Patent Application No. 201280043349.2.

(Continued)

*Primary Examiner* — Jay Liddle
*Assistant Examiner* — Ryan Hsu
(74) *Attorney, Agent, or Firm* — Howard & Howard Attorneys PLLC

(57) ABSTRACT

A game machine displays a movie in which at least one object moves in a predetermined area. The game machine includes an attribute management data storage device that stores attribute management data for managing a plurality of types of attributes. And the game machine specifies at least one holes to be assigned with any one of attributes in the predetermined area, select an attribute to be assigned to the hole by lottery from attributes, assigns the attribute selected to the hole, and generates in a game, change corresponding to the attribute assigned to the hole when the object reaches the hole on the movie.

20 Claims, 12 Drawing Sheets

(58) Field of Classification Search
USPC ..... 463/16, 20, 42
See application file for complete search history.

(56) References Cited

U.S. PATENT DOCUMENTS

| | | | | |
|---|---|---|---|---|
| 2001/0036853 | A1 | 11/2001 | Thomas | |
| 2002/0094856 | A1* | 7/2002 | Bennett | G07F 17/34 463/16 |
| 2002/0098880 | A1* | 7/2002 | Rodden | G07F 17/3297 463/2 |
| 2003/0073479 | A1* | 4/2003 | Wilson | G07F 17/3213 463/16 |
| 2003/0092481 | A1* | 5/2003 | Ohara | G07D 9/00 463/20 |
| 2003/0181238 | A1* | 9/2003 | Demar | G07F 17/3267 463/20 |
| 2005/0070352 | A1* | 3/2005 | Hattori | G07F 17/3297 463/16 |
| 2006/0027973 | A1* | 2/2006 | Nireki | G07F 17/3297 273/440 |
| 2007/0155464 | A1 | 7/2007 | Baerlocher et al. | |
| 2008/0076524 | A1* | 3/2008 | Ghaly | G07F 17/32 463/20 |
| 2009/0042653 | A1* | 2/2009 | Hamada | G07F 17/3297 463/42 |
| 2009/0131141 | A1 | 5/2009 | Walker et al. | |
| 2010/0044960 | A1* | 2/2010 | Nagayama | A63F 7/00 273/138.3 |
| 2011/0028207 | A1 | 2/2011 | Gagner et al. | |
| 2013/0072287 | A1* | 3/2013 | Okuaki | G07F 17/3206 463/23 |
| 2013/0079114 | A1* | 3/2013 | Nicely | G07F 17/3239 463/25 |
| 2013/0337901 | A1* | 12/2013 | Saruta | A63F 13/10 463/25 |

FOREIGN PATENT DOCUMENTS

| | | | |
|---|---|---|---|
| JP | S62-235694 | A | 10/1987 |
| JP | 2004-008266 | A | 1/2004 |
| JP | 2007-208652 | A | 8/2007 |
| JP | 2008-43510 | A | 2/2008 |

OTHER PUBLICATIONS

Japanese Office Action (P2014-529771); dated Jul. 13, 2015.
Screen shot of whack-a-mole play in the Wii "Go Vacation" game, https://www.youtub.com/watch?v=6_qeXqvgFdg, Aug. 31, 2011, Bandai Namco Entertainment.
Japanese Office Action (JP Pat. Appln. No. P2014-529771).
International Search Report—dated Nov. 13, 2012.
Japanese Office Action (P2014-529771); dated Jul. 21, 2015.
Screen shot of whack-a-mole play in the Wii "Go Vacation" game, https://www.youtube.com/watch?y=6_qeXqygFdg, Aug. 31, 2011, Bandai Namco Entertainment.
Notice of Allowance (JP Patent Application No. P2017-000164); Dispatch Date: Feb. 6, 2018.

* cited by examiner

Fig. 9

23c

| MOVIE NO | REACHING POSITION | REACHING OBJECT | ATTRIBITES OF HOLE |
|---|---|---|---|
| MOVIE 001 | THE FIRST HOLE | NOTHING | LOSE |
| MOVIE 001 | THE SECOND HOLE | NOTHING | LOSE |
| . . . | . . . | . . . | . . . |
| MOVIE 001 | THE FOURTH HOLE | CROWN | BIG WIN |
| . . . | . . . | . . . | . . . |
| MOVIE 001 | THE NINTH HOLE | NOTHING | LOSE |
| MOVIE 002 | THE FIRST HOLE | CHARACTER | LOSE |
| . . . | . . . | . . . | . . . |

GAME MACHINE, CONTROL METHOD FOR USE IN THE GAME MACHINE, AND COMPUTER PROGRAM

CROSS REFERENCE TO RELATED APPLICATION

This application is a national stage application of PCT/US2012/053008, filed Aug. 30, 2012, which claims priority to Australian Patent Application No. 2011221364, filed Sep. 7, 2011, the disclosures of which are hereby incorporated by reference in their entirety.

TECHNICAL FIELD

The present invention relates to a game machine that displays a movie in which at least one object moves in a predetermined area, a control method for use in the game machine, and a computer program.

BACKGROUND ART

There have been game machines that display a movie in which at least one object moves in a predetermined area. Among such game machines, there is known a game machine which uses the object in the movie to determine a prize winning and provides a specific benefit to a winner in the event of winning (for example, refer to Patent Document 1).

Patent Document 1: U.S. Pub. No. US2007/0155464.

SUMMARY OF THE INVENTION

If a player can readily assume the prize winning, the fun of the game is reduced. Therefore, in the game machine of Patent Document 1, it is necessary to provide variations in the course leading to the determination of the prize winning. In this case, a long movie containing such variations is necessary. Otherwise, movies corresponding to such variations are necessary. In all the cases, a storage capacity for storing the movie inevitably increases. Meanwhile, in a case where the movies presenting different courses are created for each event of the prize determination, it takes a long time to create the movies for each prize determination. In this case, the cost for devices such as a computer necessary for creating the movies may increase.

In this regard, an object of the present invention is to provide a gaming machine which can use a same movie for different drawing results, and, to provide a control method used therein and a computer program.

In order to solve the above problems, a game machine according to an aspect of the present invention is a game machine displaying a movie in which at least one object moves in a predetermined area, the game machine includes: an attribute management data storage device that stores attribute management data for managing a plurality of types of attributes; a position specifying device that specifies at least one determination position to be assigned with any one of the plurality of types of attributes in the predetermined area; an attribute lottery device that select an attribute to be assigned to the determination position by lottery from a plurality of types of attributes; an attribute assigning device that assigns the attribute selected by the attribute lottery device to the determination position; and a change generating device that generates in a game, change corresponding to the attribute assigned to the determination position when the object reaches the determination position on the movie.

According to the invention, when the object reaches the determination position in the movie, change corresponding to the attribute of the determination position occurs. The attribute of the determination position is determined by lottery. Therefore, even in the same movie in which the object moves along the same path, the change generated when the object reaches the determination position is different. That is, the same movie can be used in different lottery results.

In order to solve the above problems, a method of controlling a computer of the game machine of the present invention includes the following steps. The game machine displays a movie in which at least one object moves in a predetermined area and includes an attribute management data storage device that stores attribute management data for managing a plurality of types of attributes. The steps are: a position specifying step that specifies at least one determination position to be assigned with any one of the plurality of types of attributes in the predetermined area; an attribute lottery step that select an attribute to be assigned to the determination position by lottery from a plurality of types of attributes; an attribute assigning step that assigns the attribute selected by the attribute lottery step to the determination position; and a change generating step that generates in a game, change corresponding to the attribute assigned to the determination position when the object reaches the determination position on the movie.

In order to solve the above problems, a computer program for a game machine of the present invention is configured to make a computer of the game machine displaying a movie in which at least one object moves in a predetermined area and including an attribute management data storage device that stores attribute management data for managing a plurality of types of attributes serve as: a position specifying device that specifies at least one determination position to be assigned with any one of the plurality of types of attributes in the predetermined area; an attribute lottery device that select an attribute to be assigned to the determination position by lottery from a plurality of types of attributes; an attribute assigning device that assigns the attribute selected by the attribute lottery device to the determination position; and a change generating device that generates in a game, change corresponding to the attribute assigned to the determination position when the object reaches the determination position on the movie.

BRIEF DESCRIPTION OF THE DRAWINGS

FIG. 9 is a diagram illustrating an exemplary content of attribute management data;

DETAILED DESCRIPTION OF EMBODIMENTS

Figure 1:
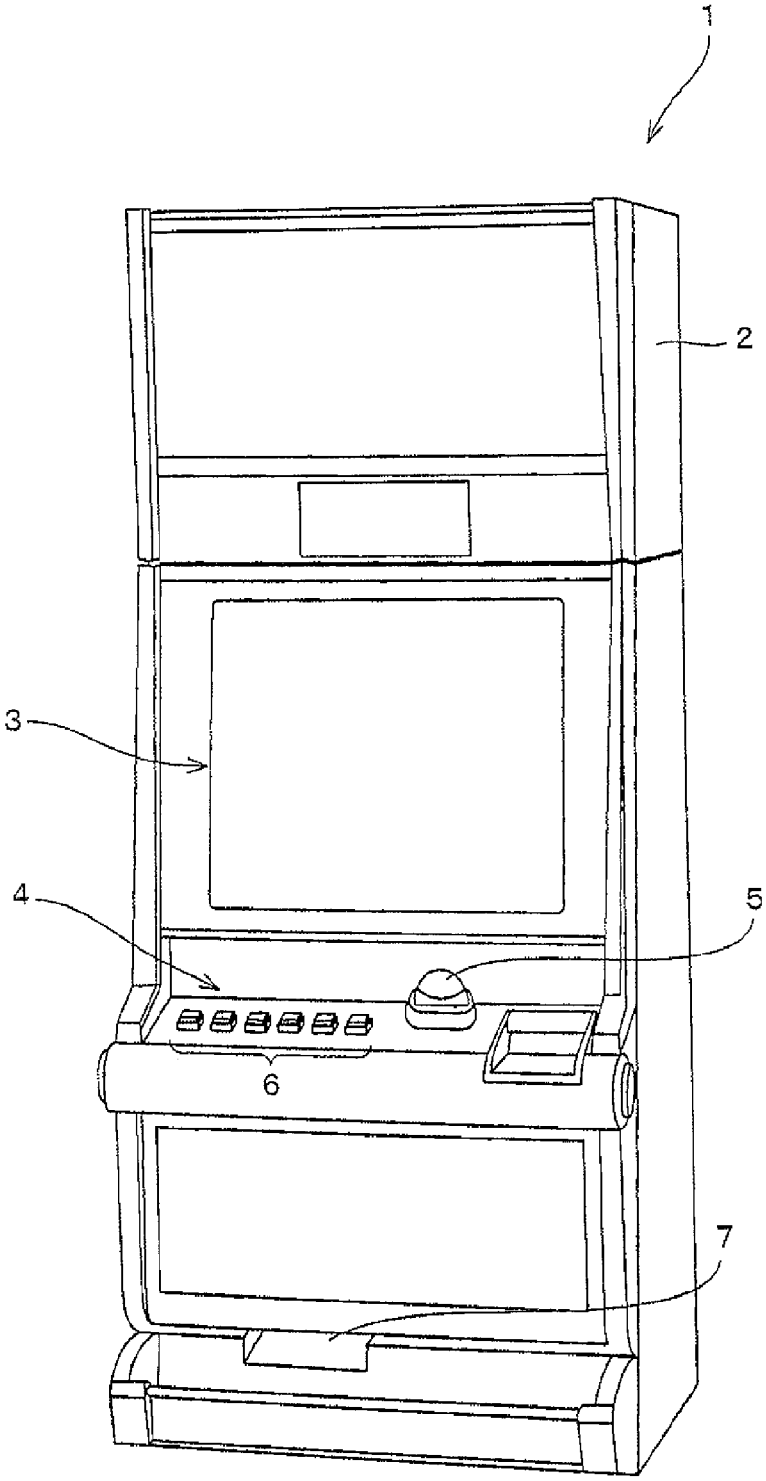
FIG. 1 is an external view of a game machine according to an embodiment of the invention.

Hereinafter, a game machine according to an embodiment of the present invention will be described with reference to the drawings. FIG. 1 is an external view of a game machine according to an embodiment of the invention. The game machine 1 is configured as a game machine of a slot machine type. As illustrated in FIG. 1, the game machine 1 has a chassis 2. On a front surface of the chassis 2, there is provided a display device 3. For example, a liquid crystal display device is applied as the display device 3.

A control panel 4 is provided below the display device 3. A coin slot 5 and an operation device 6 are provided on the control panel 4. The operation device 6 includes operation members for performing various operations such as betting operation or the like. Also, a payout port 7 of the coins is provided below the control panel 4.

Figure 2:
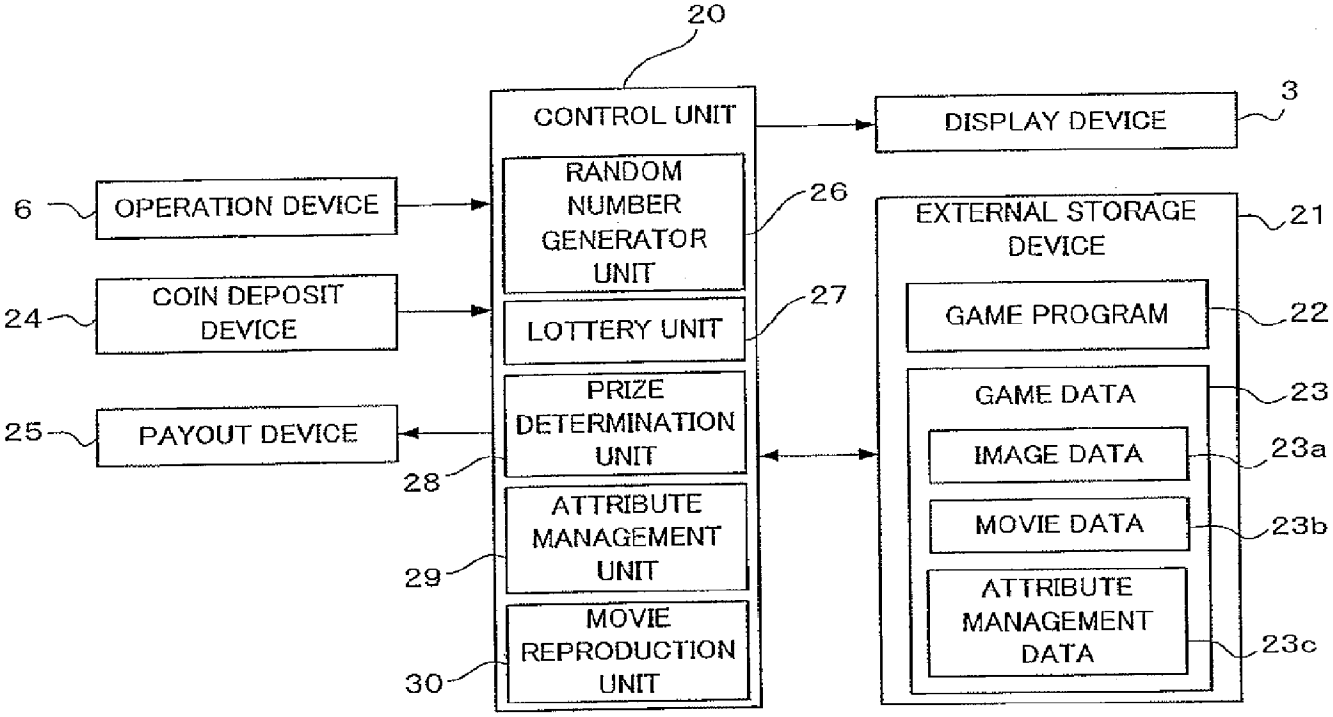
FIG. 2 is a functional block diagram of the game machine.

The configuration of the game machine 1 will be further described with reference to the FIG. 2. FIG. 2 is a functional block diagram of the game machine. As illustrated in FIG. 2, a control unit 20 is provided inside the chassis 2 of the game machine 1. The control unit 20 is configured as a computer unit including a microprocessor and other peripheral devices, such as a main storage device needed for the operation thereof and the like. An external storage device 21 is connected to the control unit 20.

As the external storage device 21, there is used a storage medium which is capable of holding storage without feeding of power, for example, an optical storage medium such as a DVD-ROM and a CD-ROM, or a nonvolatile semi conductor memory device such as an EEPROM.

The external storage device 21 stores a game program 22 and a game data 23. The game program 22 is a program that is needed to cause the game machine 1 to execute a game. The game data 23 is various kinds of data that is utilized when the game program 22 is executed. The game program 22 is appropriately read and is executed by the control unit 20. Also, the game data 23 is appropriately read and is referred by the control unit 20.

Game data 23 includes image data 23*a*, movie data 23*b*, and attribute management data 23*c*. The image data 23*a* is used to display various images necessary in the game on the display unit 3. The movie data 23*b* is used to display various movies necessary in the game on the display unit 3.

The attribute management data 23*c* are used to manage attributes such as a win, a big win, or the like in various movies displayed by the move data 23*b*. Details of the attribute management data 23*c* will be described below. Although the game program 22 includes various program modules necessary to execute the game, these modules are not illustrated. Similarly, although the game data 23 additionally includes various kinds of data such as effective sound data, dividend data, and reel data, these kinds of data are not illustrated.

The operation device 6 and the display device 3 described above are connected to the control unit 20. The operation device 6 outputs a signal corresponding to the operation of a player to the control unit 20. The display device 3 displays an image (including a movie) corresponding to the image signal output from the control unit 20. The control unit 20 executes a game in a predetermined sequence according to the game program 22 with reference to the output signal of the operation device 6. At the same time, the control unit 20 displays the game screen depending on a game status on the display device 3. The game screen includes, for example, various kinds of movies displayed based on the movie data 23*b*.

As an input device or an output device that is needed to execute the game, a coin deposit device 24 and a payout device 25 are further connected to the control unit 20. The coin deposit device 24 receives a deposit of coins as a value for playing a game through the slot 5 of coins. And, the coin deposit device 24 outputs a signal according to a deposit amount of coins to the control unit 20.

The payout device 25 executes a payment of coins as a dividend of the game to the player according to an instruction from the control unit 20. The payment of coins is executed through the payout port 7. In addition, receiving the value for playing the game and the dividend to the player are not limited to coins. For example, as alternative currency, medals, tokens or the like may be used. Also, a settlement method that enables an exchange of a game value (including a currency value) through an exchange of electronic information such as an electronic currency or the like may be used. In this case, an information communication device that exchanges the electronic information mutually, a storage medium that stores information which is exchanged, or the like may be used instead of the slot 5 of coins and the payout port 7.

In the control unit 20, there are provided a random number generator unit 26, a lottery unit 27, a prize determination unit 28, an attribute management unit 29, and a movie reproduction unit 30. The random number generator unit 26 generates random numbers of a predetermined digit numbers. The random number generator unit 26 is a logical device that is realized by a combination of a microprocessor and software. In addition, the random number generator unit 26 may be a physical device where is combined with electronic circuits.

The lottery unit 27 obtains a random number from the random number generator unit 26 and executes various kinds of lottery. The lottery includes, for example, a lottery of the stop position of the virtual reel for realizing a slot game. The prize determination unit 28 determines whether or not the player wins the prize based on the lottery result of the lottery unit 27. The attribute management unit 29 executes management of the attribute management data 23*c* and the like. The management of the attribute management data 23*c* includes updating of contents of the attribute management data 23*c*. The movie reproduction unit 30 displays various movies on the display device 3 based on the movie data 23*b*. The lottery unit 27, the prize determination unit 28, the attribute management unit 29, and the movie reproduction unit 30 are logical devices realized by combining a microprocessor and software. While the control unit 20 further includes logical devices or physical devices necessary to execute the slot game, they are not illustrated.

Figure 3:
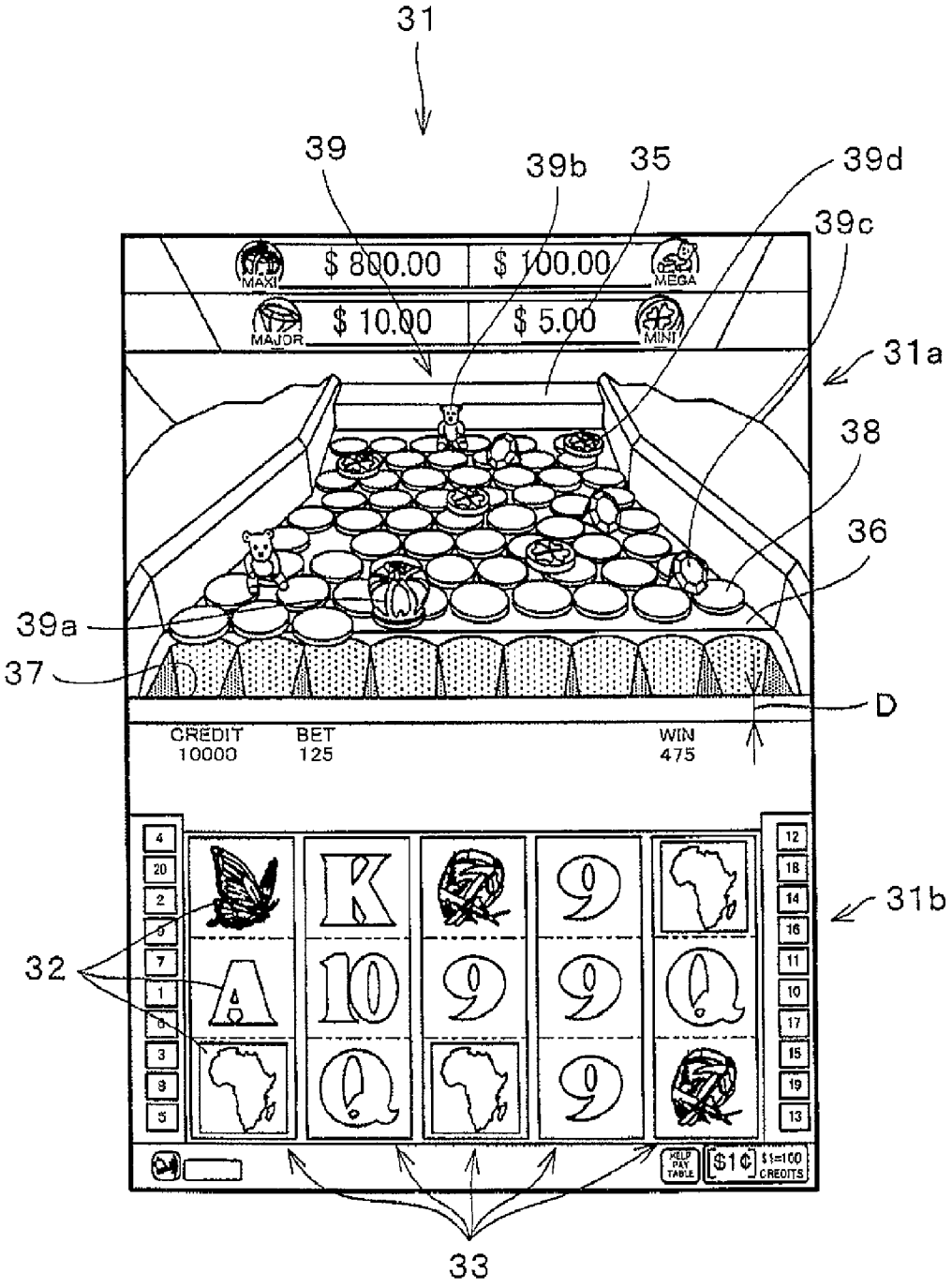
FIG. 3 is a diagram illustrating an exemplary game screen.

Next, the game executed by the game machine 1 will be described with reference to FIGS. 3 to 7. FIG. 3 is a diagram illustrating an exemplary game screen. The game screen 31 includes a pusher game area 31*a* and a slot game area 31*b* as a predetermined area. A gap D may be interposed between the pusher game area 31*a* and the slot game area 31*b*. In addition, the gap D may be omitted.

In the slot game area 31*b*, a slot game known in the art is provided using a plurality of virtual reels 33 including symbols 32. In such a slot game, a gamer wins a prize and receives a dividend, for example, when a predetermined arrangement is formed by the same symbol 32 on reels 33.

In the pusher game area 31*a*, a pusher game is provided as a bonus game when a predetermined condition is satisfied in the slot game of the slot game area 31*b*. The predetermined condition is satisfied, for example, when a predetermined arrangement is formed by a predetermined symbol 32 or when a particular symbol 32 is included in an arrangement.

In the pusher game area 31*a*, there is reproduced a movie based on the movie data 23*b*. The movie includes displays such as a pusher 35, a table 36, and 9 holes 37 as determination positions. The 9 holes 37 are arranged side by side in a horizontal line along the leading edge side of the table 36. Also, each hole 37 is displayed so that each hole 37 can be discriminated as the reaching position of coins 38 etc. or disappearing position at which the displays of reaching coins 38 etc. disappear, from other portions. Coins 38 and objects 39 are arranged on the table 36. Also, the objects 39 are displayed in the forms such as a crown 39*a*, a bear 39*b*, a diamond 39*c*, and a special coin 39*d*.

The pusher 35 is displayed to move to a certain position in the direction of the hole 37 on the table 36. After movement to a certain position, the pusher 35 returns to the initiation position. As such, the pusher 35 is displayed to reciprocate between the certain position and the initiation position.

In the pusher game area 31*a*, the same movie is repeatedly reproduced until a predetermined condition is satisfied. Such a movie does not include an image containing the coin 38 and the object 39 within a movable range of the pusher 35, that is, from the certain position to the initiation position. That is, the coin 38 and the object 39 are not displayed within the movable range of the pusher 35. Therefore, in this movie, there is no change except for reciprocating of the pusher 35.

Figure 4:
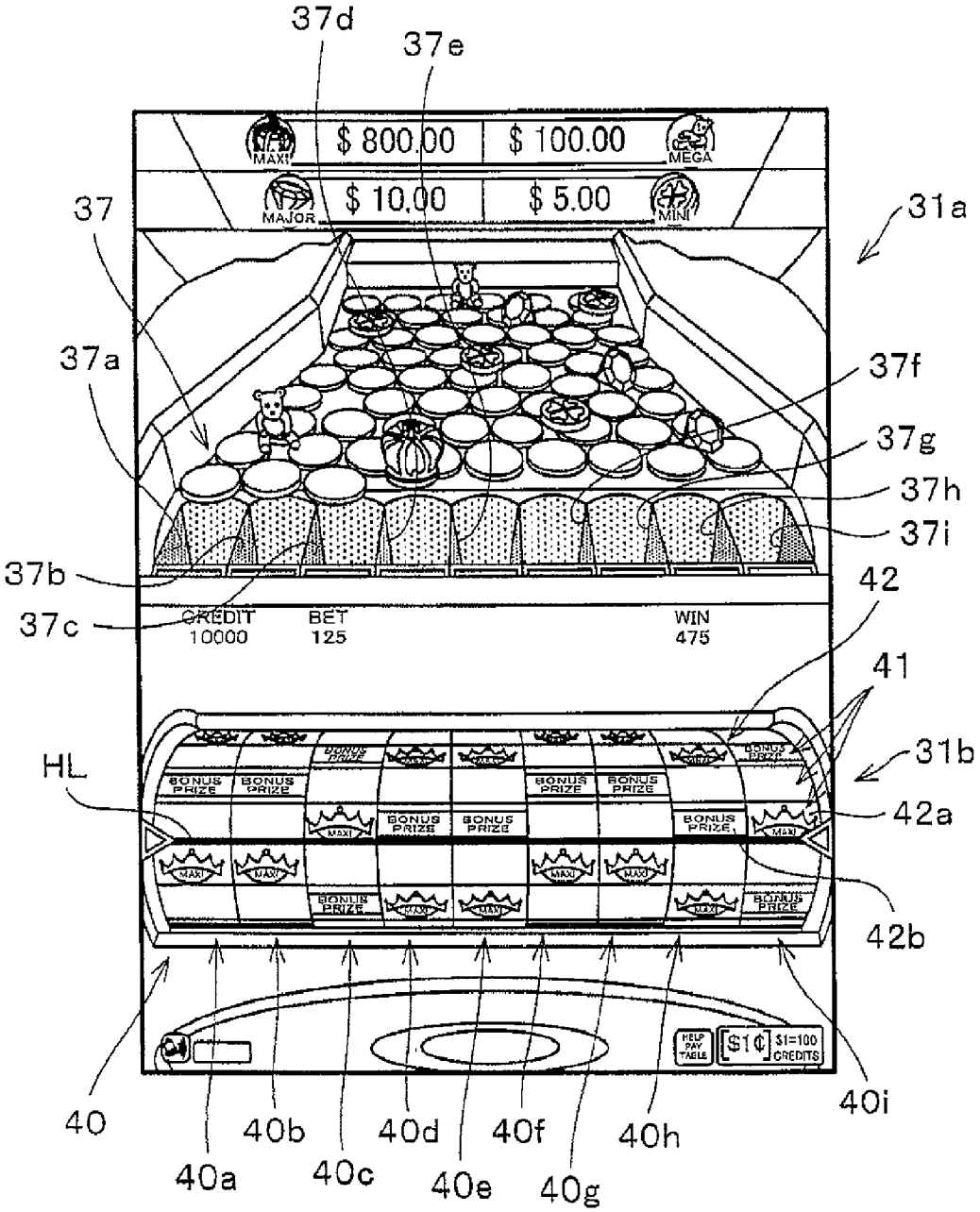
FIG. 4 is a diagram illustrating an exemplary game screen where a bonus slot game is provided.

Meanwhile, in a case where the predetermined condition is satisfied, the display of the slot game area 31*b* is switched. After the switching, the bonus slot game is provided in the slot game area 31*b*. FIG. 4 is a diagram illustrating an exemplary game screen where the bonus slot game is provided.

As shown in FIG. 4, in the slot game area 31*b*, there are displayed 9 virtual reels 40 and a determination line HL extending in a horizontal direction across each virtual reel 40. Each of 9 virtual reels 40 corresponds to each of 9 holes 37 of the pusher game area 31*a*. Specifically, each virtual reel 40 corresponds to each hole 37 such as a first virtual reel 40*a* positioned in the left end of the 9 virtual reels 40 corresponds to the first hole 37*a* positioned in the left end of the 9 holes 37, and the neighboring second virtual reel 40*b* corresponds to the second hole 37*b* neighboring to the first hole 37*a*, and the like. Such a relationship may be implemented by using a table (not shown) that defines a relation between each virtual reel 40 and each hole 37.

The virtual reel 40 is configured by arranging a predetermined number of symbol areas 41 in a certain direction. In each symbol area 41, the symbols 42 are partially arranged. The symbols 42 include a crown FIG. 42*a* and a character FIG. 42*b*. The symbol 42 also serves as information indicating a win attribute. Specifically, the crown FIG. 42*a* has a big win attribute, and the character FIG. 42*b* has a win attribute. In addition, in a case where no symbol 42 is included in the symbol area 41, it serves as information indicating a lose attribute.

In addition, each symbol 42 and the win attribute may be defined in a table (not shown) which relates them with each other. Also, for example, each symbol area 41 included in each virtual reel 40 and the type of the symbol 42 in each symbol area 41 may be defined in reel data (not shown) which specifies them. The arrangement of the symbols 42 in each virtual reel 40 may be identical to or different from each other. Also, the virtual reel 40 is a substance having a cylindrical shape similar to a mechanical reel in which symbols are arranged in the outer circumference of the cylindrical body.

Meanwhile, in a case where a predetermined condition is satisfied, the movie reproduced in the pusher game area 31*a* is switched. And, if the bonus slot game is initiated, each virtual reel 40 is scrolled up to down. The scrolling is performed so as to virtually represent the movement of the symbols when a physical reel rotates by replacing the movement by image display. At predetermined stop timing, each virtual reel 40 stops.

Figure 5:
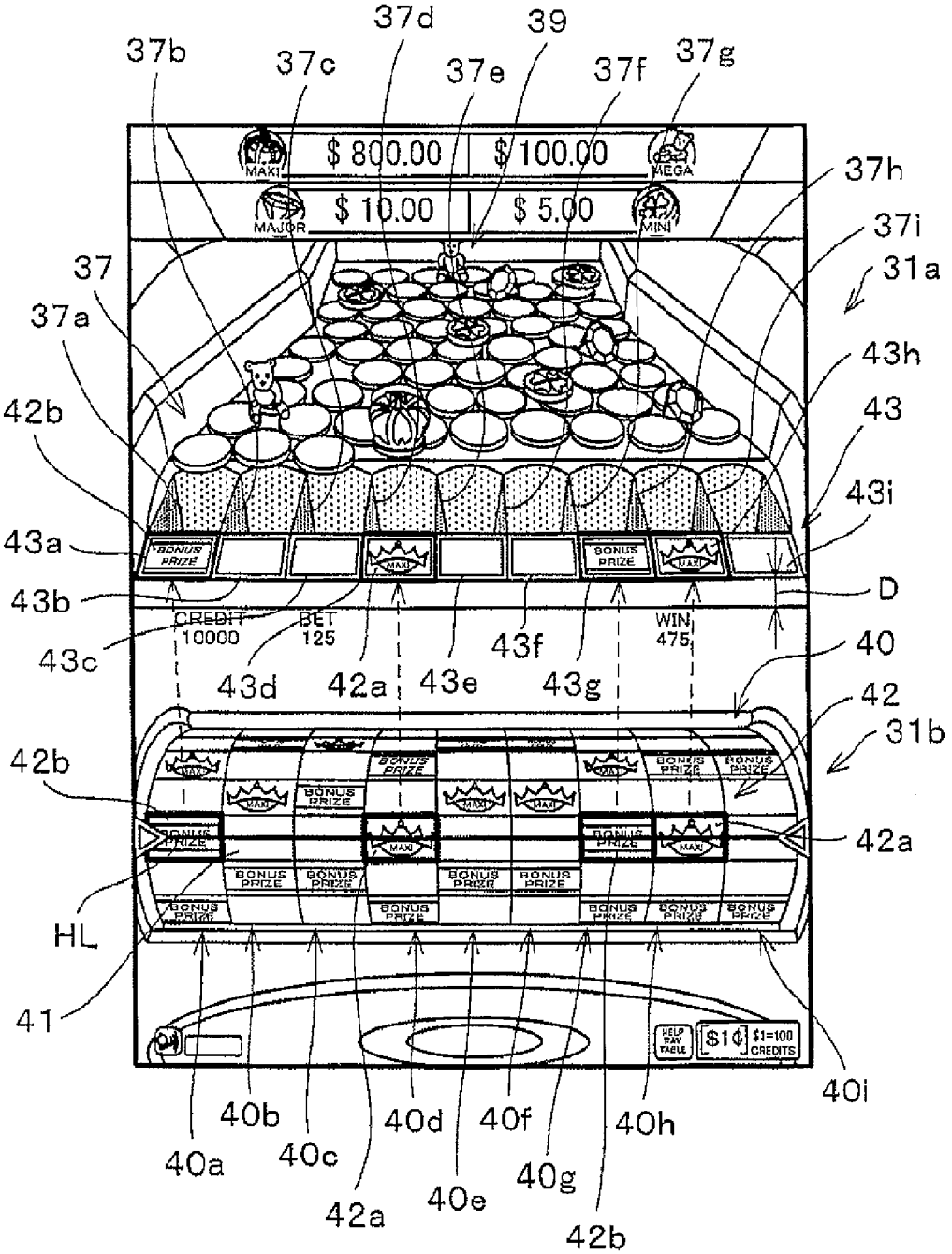
FIG. 5 is a diagram illustrating an exemplary game screen after a predetermined time passes from the state of FIG. 4.

FIG. 5 is a diagram illustrating an exemplary game screen after a predetermined time elapse from the state of FIG. 4, and the virtual reel 40 stops. As shown in FIG. 5, in the pusher game area 31*a* after the switching, 9 label portions 43 corresponding to 9 holes 37 are displayed. Also, the symbols 42 positioned on the determination line HL when each virtual reel 40 stops are copied and displayed in each label portion 43 of each hole 37 associated through each virtual reel 40.

In the example of FIG. 5, on the determination line HL, there is displayed the character FIG. 42*b* on the first virtual reel 40*a* and the crown FIG. 42*a* on the fourth virtual reel 40*d* positioning three reels away from the first virtual reel 40*a*. Similarly, on the determination line HL, there is displayed the character FIG. 42*b* on the seventh virtual reel 40*g* positioning three reels away from the fourth virtual reel 40*d* and the crown FIG. 42*a* on the eighth virtual reel 40*h* neighboring the seventh virtual reel 40*g*. Also, symbol 42 is not arranged in the symbol areas 41 of virtual reels positioned along the determination line HL other than the first, fourth, seventh, and eighth virtual reels 40*a*, 40*d*, 40*g*, and 40*h*.

Therefore, in the example of FIG. 5, each symbol 42 positioned along the determination line HL in the first, fourth, seventh, and eighth virtual reels 40*a*, 40*d*, 40*g*, and 40*h* is copied and displayed in each label portion 43 corresponding to the virtual reels 40*a*, 40*d*, 40*g*, and 40*h*. Specifically, the character FIG. 42*b* is displayed on the first label portion 43*a* of the first hole 37*a* corresponding to the first virtual reel 40*a*, and the crown FIG. 42*a* is displayed on the fourth label portion 43*d* of the fourth hole 37*d* corresponding to the fourth virtual reel 40*d*. Similarly, the character FIG. 42*b* is displayed on the seventh label portion 43*g* of the seventh hole 37*g* corresponding to the seventh virtual reel 40*g*, and the crown FIG. 42*a* is displayed on the eighth label portion 43*h* of the eighth hole 37*h* corresponding to the eighth virtual reel 40*h*.

An attribute corresponding to the symbol 42 displayed on the label portion 43 is assigned to each hole 37. Specifically, the big win attribute is assigned to the hole 37 by displaying the crown FIG. 42*a* on the label portion 43, and the win attribute is assigned to the hole 37 by displaying the character FIG. 42*b*. Meanwhile, in a case where symbol 42 is not displayed on the label portion 43, a lose attribute is assigned to each hole 37. And, in a case where an object 39 drops to the hole 37 corresponding to the win or big win attribute, a bonus is provided. In addition, presentations such as a presentation of a notification that each symbol 42 is copied, a presentation of a movement that such a copied symbol 42 moves to each label portion 43, or the like may be provided. In this case, presentation may be made such that each moving symbol 42 disappears at one time on the gap D between the pusher game area 31*a* and the slot game area 31*b*.

After each symbol 42 is displayed in each label portion 43, the movie reproduced on the pusher game area 31*a* is switched again. Specifically, on the pusher game area 31*a*, there is reproduced a movie that a coin 38 or an object 39 drops from the upper direction, and the dropped coin 38 or the like is arranged in the movable range of the pusher 35. In this movie, as the pusher 35 reciprocates, the coin 38 or the like arranged in the movable range on the table 36 is pushed by the pusher 35 and moves toward the hole 37.

Figure 6:
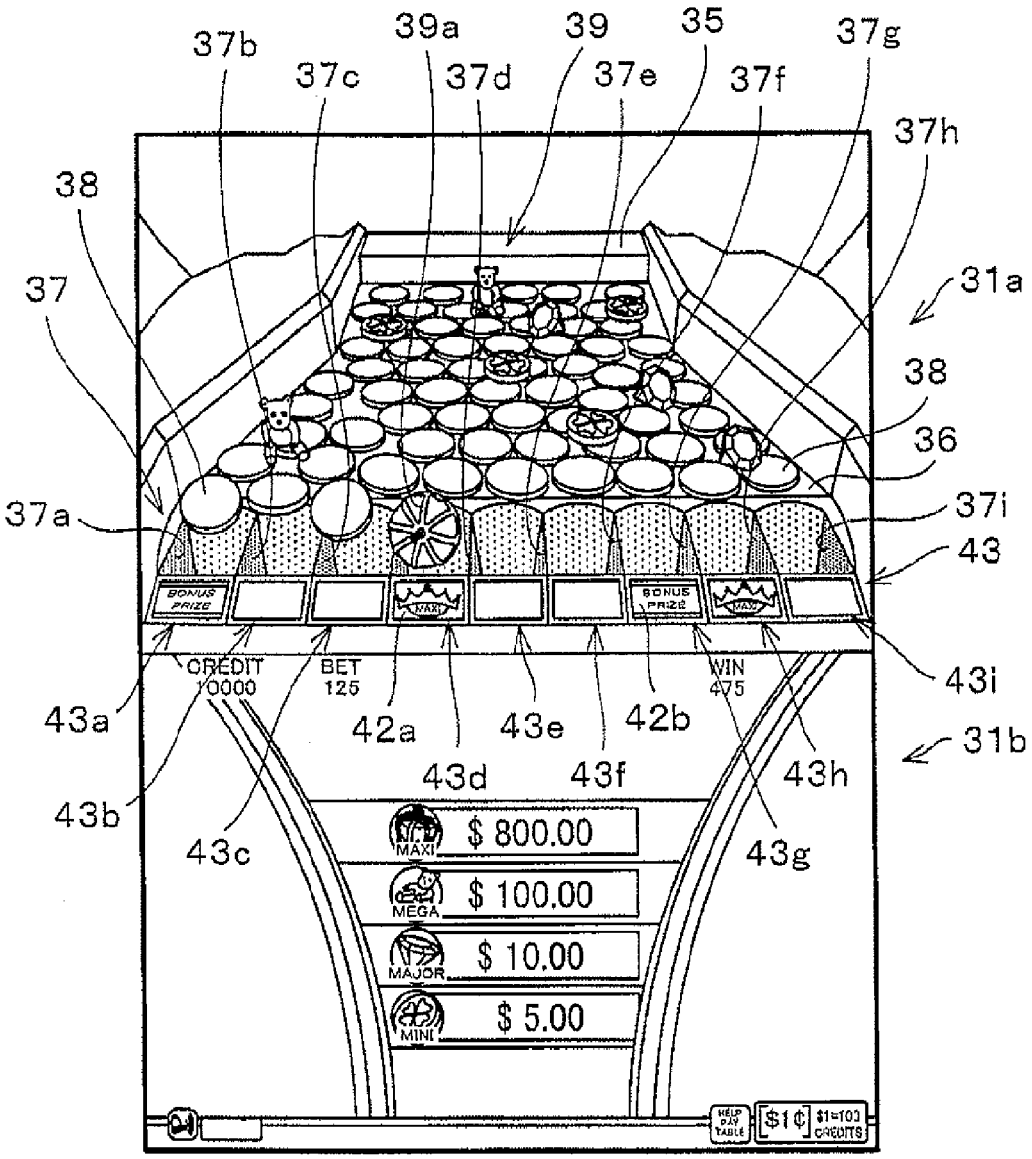
FIG. 6 is a diagram illustrating an exemplary game screen after a predetermined time passes from the state of FIG. 5.

FIG. 6 is a diagram illustrating an exemplary game screen after a predetermined time elapses from the state of FIG. 5, and the movie is switched to an movie including dropping of the coin 38 or the like in the pusher game area 31*a*. As shown in FIG. 6, in the switched movie, there are included displays that as the dropped coins 38 and the like are pushed toward the holes 37, other coins 38 are also pushed. And, in the movie, there is also displayed other coins 38 and the object 39 thereon so as to move toward the holes 37. By virtue of such a movement, in the movie, there is displayed the coins 38 located at the leading end side on the table 36 so as to be pushed in a chain reaction. And, if the coins 38 and the objects 39 at the leading end side in the movie are pushed toward the holes 37 from a predetermined position, they are displayed so as to drop to the holes 37.

Meanwhile, a dividend table corresponding to the big win is displayed in the slot game area 31*b*. Specifically, a dividend corresponding to the shape of the object 39 is displayed when the object 39 drops to the hole 37 where the crown FIG. 42*a* is displayed in the label portion 43.

In the example of FIG. 6, the coins 38 dropping to the first hole 37*a* and third hole 37*c* are displayed. Also, the crown 39*a* is dropping to the fourth hole 37*d*. Therefore, in this case, there is provided a dividend to a player in a case where the shape of the object 39 is crown 39*a*. Specifically, in the example of FIG. 6, "$800" is provided to a player as a dividend. Meanwhile, in a case where the object 39 drops to the hole 37 corresponding to the character FIG. 42*b*, there is provided a predetermined dividend regardless of a shape thereof. As a predetermined dividend, for example, a lowest dividend in the dividend table, or a fixed dividend lower than that may be used.

Figure 7:
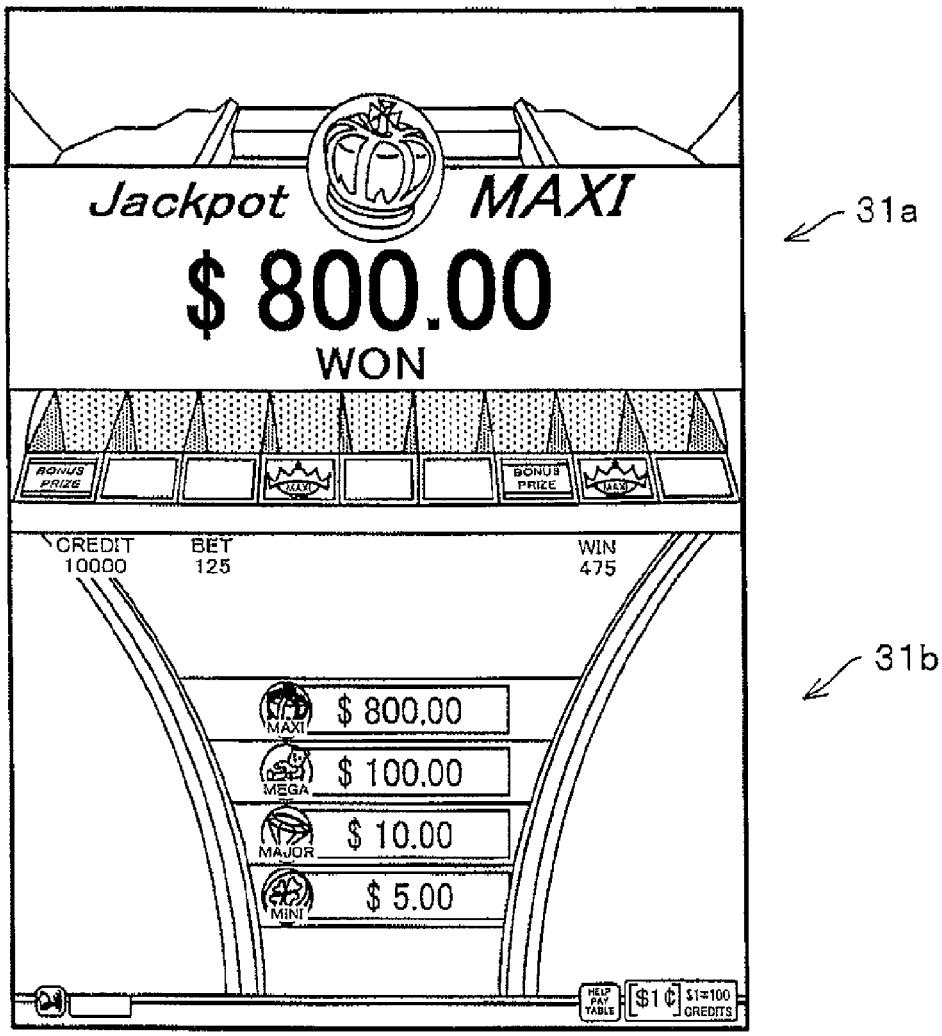
FIG. 7 is a diagram illustrating an exemplary game screen when a big win occurs.

In a case where a big win is generated, the provided dividend is notified to the player. FIG. 7 is a diagram illustrating an exemplary game screen when the big win is drawn. As shown in FIG. 7, the type of the big win and the dividend thereof are displayed in the pusher game area 31*a*.

Figure 8:
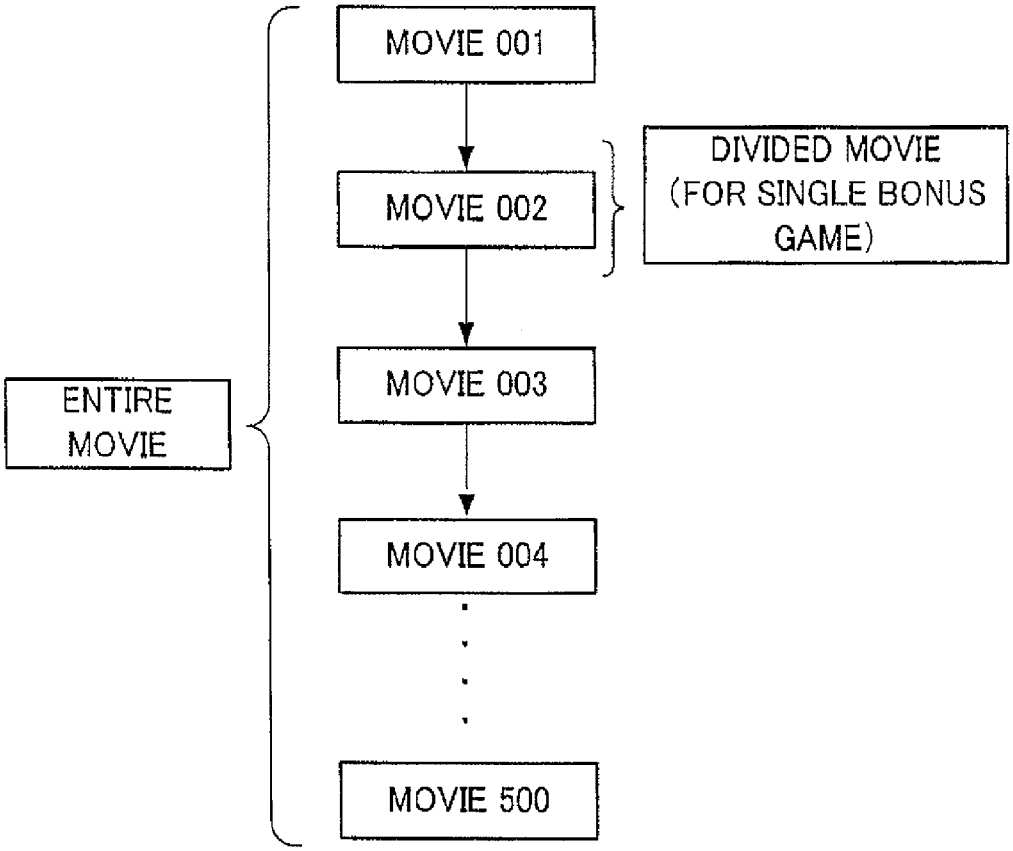
FIG. 8 is a diagram for describing a configuration of a movie.

Next, the movie data 23*b* and the attribute management data 23*c* will be described. The movie data 23*b* are configured to display the pusher game having continuity. FIG. 8 is a diagram for describing a configuration of the movie displayed by the movie data 23*b*. As shown in FIG. 8, the entire movie for presenting a series of pusher games having continuity is divided into a plurality of movies. That is, the entire movie includes a plurality of divided movies. Therefore, the movie data 23*b* contain each of data for respectively reproducing a plurality of divided movies. Also, the contents of each divided movie such as movement paths of the object 39, drop positions, or the like differ form each other. However, the data for reproducing each divided movie is configured so as to reproduce the divided movies of the same contents whenever they are used for reproduction. That is, no matter how many times each divided movie is reproduced, the content of each divided movie dose not change.

Divided movies are reproduced in a predetermined sequence. Each divided movie is numbered in a reproduction sequence. In the example of FIG. 8, a number "001" is assigned to the divided movie that is initially reproduced. Then, each divided movie is numbered in a reproduction sequence such as "002" and "003."

Each divided movie is different in arrangement of the added coin 38 and object 39, movement paths of the coin 38 and the object 39, and the like. A single divided movie is reproduced corresponding to a single bonus game. The movie 002 is a movie continuously following the movie 001. Specifically, the movie 002 is a movie initiated from the termination state after the movie of the movie 001 is terminated, that is, from the state immediately after the coins 38 and the like are pushed by the pusher 35, and the chain reaction of the coins 38 and the like is terminated. Therefore, by reproducing each divided movie in the reproduction sequence order of the movie 001, the movie 002, the movie 003, and go on, the entire movie is realized such that the pusher 35 reciprocates repeatedly and drops the coins 38 etc. to the hole 37.

In the example of FIG. 8, the entire movie is divided into 500 divided movies. In this case, the movie 001 is a movie corresponding to continuation of the movie 500. That is, the divided movie initially reproduced corresponds to continuation of the divided movie finally reproduced. As a result, the entire movie is configured so as to have continuity even when it is repeatedly reproduced.

Meanwhile, FIG. 9 is a diagram illustrating an exemplary content of the attribute management data 23*c*. As shown in FIG. 9, the attribute management data 23*c* contains information of the movie number, information of the reaching positions, information of the reaching object 39, and information of attributes of the hole. The attribute management data 23*c* is configured as assemblies of records associated with such information.

The information of the movie number is information for specifying any one of the divided movies. For example, as the information of the movie number, unique numbers allocated to each divided movie are described. Information of the reaching positions is information indicating positions where the object 39 reaches in the movie, more specifically, indicating the holes 37 where the object 39 reaches. For example, as the information of reaching positions, there is described information indicating any one of 9 holes 37 such as the first hole 37*a*, the second hole 37*b*, and the like. The attribute management data 23*c* also serve as reaching position data of the invention by including the information of reaching positions.

The information of the reaching object is the information indicating the shape of the object 39 which reaches the hole 37 specified by the information of the reaching position. For example, as the information of the reaching object, there is described the shape such as a crown 39*a* and a bear 39*b*. The information of attributes of the hole is information indicating the win attribute of the hole 37 specified by the information of the reaching position. For example, as the information attributes of the hole, there is described any one of the attributes such as a lose, a win, or a big win.

In the example of FIG. 9, in the "movie 001" corresponding to the first one of the divided movies, information indicating that no object 39 reaches the first hole 37*a* is described. Also, as the attribute of the first hole 37*a*, "lose" is also described. Meanwhile, information that the object 39 of the crown 39*a* reaches to the fourth hole 37*d* of the "movie 001" is described. Also, information indicating "big win" is described as the attribute of the fourth hole 37*d*.

Although records are provided for each divided movie and for each hole 37 similarly, they are not illustrated in FIG. 9.

Next, a bonus game routine executed by the control unit 20 will be described. The control unit 20 executes a bonus game routine shown in FIG. 10 as a process necessary in the bonus game in a case where a predetermined condition is satisfied in the slot game in the slot game area 31*b*. In addition, although the control unit 20 also executes various other routines to implement the bonus game, the slot game, or the like, detailed description thereof is omitted since the processes of them are known in the art.

Figure 10:
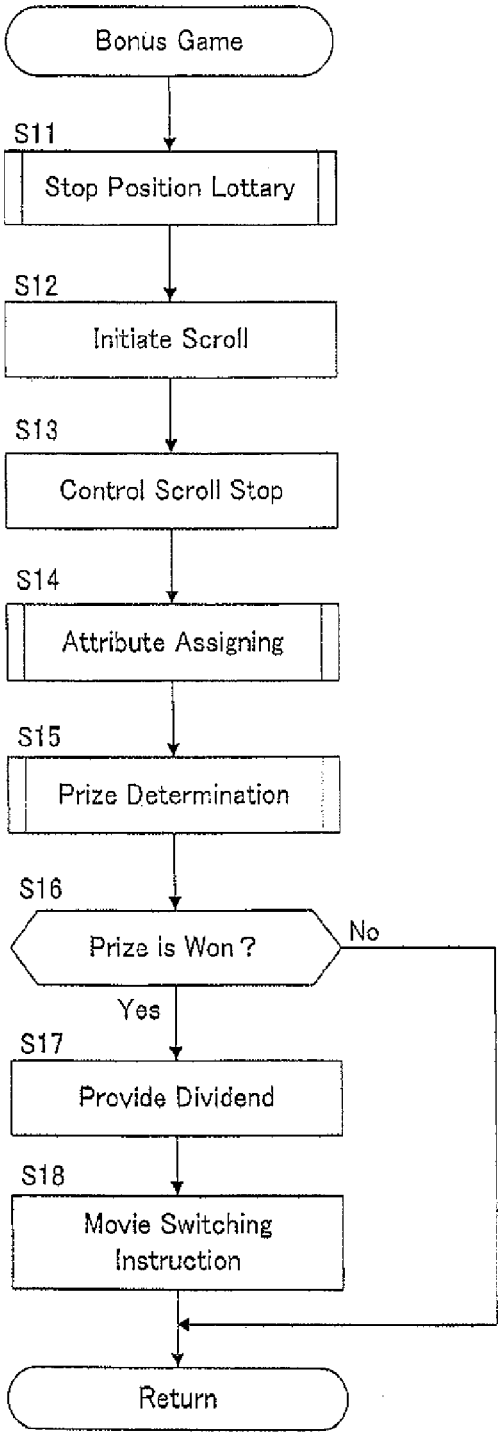
FIG. 10 is a diagram illustrating an exemplary flowchart of a bonus game routine.

FIG. 10 is a diagram illustrating an exemplary flowchart of the bonus game routine executed by the control unit 20. If the routine of FIG. 10 is initiated, at first, the control unit 20 executes a subroutine for selecting a stop position of each virtual reel 40 by lottery in step S11. In this subroutine, for each virtual reel 40, a symbol area 41 that is to stop on the determination line HL is selected by lottery. Such a lottery is performed in a manner such that the lottery unit 27 obtains a random number from the random number generator unit 26. From the result of the lottery, each symbol area 41 on the determination line HL and each symbol 42 included therein are determined for each virtual reel 40. In addition, similar to the slot game, this subroutine can be implemented in the processing known in the art, and detailed description thereof is omitted.

Subsequently, in step S12, the control unit 20 initiates scrolling of each virtual reel 40. Then, in step S13, the control unit 20 stops each virtual reel 40 in the stop position determined in step S11. Then, the control unit 20 advances the process to step S14, and executes a subroutine for determining attributes of each hole 37. Details of the subroutine will be described below.

Subsequently, in step S15, the control unit 20 executes a subroutine for determining a prize. Details of the subroutine will be described below. Then, in step S16, the control unit 20 determines a prize by using the prize determination unit 28. Specifically, winning a prize is determined by using a result of the processing in the subroutine of step S15. If the determination result of step S16 is negative, that is, if it is determined that a user fails to win a prize, the control unit 20 skips steps S17 and S18, and the present bonus game routine is terminated.

Meanwhile, if it is determined that determination result of step S16 is positive, that is, if it is determined that a user wins a prize, the control unit 20 advances the process to step S17. In step S17, the control unit 20 provides a predetermined dividend to a player depending on the type of the prize corresponding to a win, a big win, and the like. The predetermined dividend may be managed by the dividend data (not shown) for associating each type of the prize with each dividend.

Subsequently, in step S18, the control unit 20 outputs a movie switching instruction to the movie reproduction unit 30 so that the movie displayed in the pusher game area 31*a* is switched to the next movie according to a predetermined sequence, and terminates this routine. The movie reproduction unit 30 displays the next movie in the pusher game area 31*a* in response to the movie switching instruction. As a result, the bonus game can be executed, and the movie of the pusher game area 31*a* can switch to the next movie after the end thereof.

Figure 11:
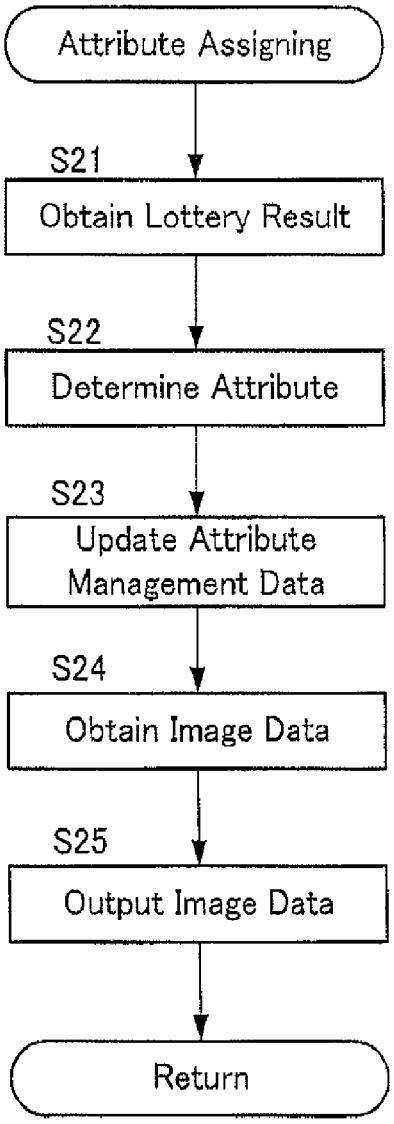
FIG. 11 is a diagram illustrating an exemplary flowchart of an attribute assigning routine.

FIG. 11 is a diagram illustrating an exemplary flowchart of the attribute assigning routine executed by the control unit 20. The subroutine of FIG. 11 is called in step S14 of FIG. 10 and executed as a subroutine process of the bonus game routine. This process is executed using the attribute management unit 29.

If the attribute assigning routine of FIG. 11 is initiated, at first, the control unit 20 obtains the lottery result in step S11 of the routine of FIG. 10 in step S21. Specifically, information of each symbol 42 for every virtual reels 40 arranged on the determination line HL is obtained by the lottery. The information of this symbol 42 also contains information that the symbol 42 is not included in the symbol area 41. Then, in step S22, the control unit 20 determines the attribute corresponding to each symbol 42 obtained in step S21. Specifically, a big win attribute is determined in the case of the crown FIG. 42*a*, a win attribute is determined in the case of the character FIG. 42*b*, and a lose attribute is determined in the case of no symbol. Such determination is implemented, for example, based on a table (not shown) associating each symbol with wins attribute.

Subsequently, in step S23, the control unit 20 updates the content of the attribute management data 23*c* based on the information obtained in step S21 and the attribute determined in step S22. Such updating is performed, for example, as follows. First, each hole 37 corresponding to each virtual reel 40 is determined. Such determination is implemented based on a table (not shown) that defines a relation between each virtual reel 40 and each hole 37. Next, the control unit 20 specifies records corresponding to each determined hole 37 based on information of the reaching position in the attribute management data 23*c*. And, the control unit 20 updates information of the attribute of the hole in the attribute management data 23*c* such that each attribute determined in step S22 is assigned to the records of each specified hole 37. That is, the information of attribute of the hole in the attribute management data 23*c* is updated such that the symbols corresponding to each hole 37 are specified, and the attribute corresponding to the symbol is assigned to each hole 37. Specifically, the information of attributes of the hole is updated such that the big win attribute is assigned to the hole 37 corresponding to the crown FIG. 42*a*, and the win attribute is assigned to the hole 37 corresponding to the character FIG. 42*b*. Meanwhile, the information of attributes of the hole is updated such that the lose attribute is assigned to the hole 37 corresponding to the virtual reel 40 having no figure, that is, the hole 37 not corresponding to these figures.

Then, in step S24, the control unit 20 obtains the image data corresponding to each symbol 42. Specifically, the control unit 20 obtains data for displaying the crown FIG. 42*a* or the character FIG. 42*b* from the image data 23*a*. Subsequently, in step S25, the control unit 20 outputs image data obtained in step S24 such that the crown FIG. 42*a* or the character FIG. 42*b* are arranged in a predetermined position of the pusher game area 31*a*. The positions of each label portion 43 are used as a predetermined position. That is, the control unit 20 outputs such image data such that the crown FIG. 42*a* or the character FIG. 42*b* corresponding to the lottery result is displayed in the position of each label portion 43 of the movie. As a result, an image of each symbol 42 corresponding to the lottery result is combined and displayed on the position of each label portion 43 of the movie, and the attributes of each hole 37 are notified to the player. In addition, for example, the predetermined position may be obtained by calculations for each process, or may be obtained from position information prepared in advance in a case where the positions of each label portion 43 are fixed. Also, the image data may be output to execute the presentations such as the presentation that the crown FIG. 42*a* or the character FIG. 42*b* is copied from each virtual reel 40, the presentation that they move to each label portion 43, or the like.

If the processing in step S25 is terminated, the control unit 20 terminates the attribute assigning routine, and the process returns to the routine of FIG. 10. By executing the aforementioned subroutine, the information of attributes of the hole in the attribute management data 23*c* is updated to reflect the lottery result of the bonus game routine. Also, each symbol 42 corresponding to each attribute is displayed in the label portion 43, and as a result, the attributes of each label portion 43 corresponding to the lottery result are notified to a player.

Figure 12:
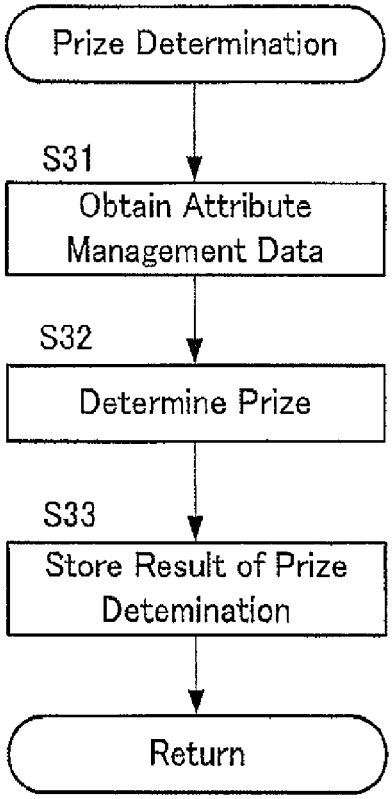
FIG. 12 is a diagram illustrating an exemplary flowchart of a prize determination routine.

FIG. 12 is a diagram illustrating an exemplary flowchart of the prize determination routine executed by the control unit 20. The subroutine of FIG. 12 is called and executed in step S15 of FIG. 10 as a subroutine process of the bonus game routine. This process is executed using the prize determination unit 28.

If the prize determination routine of FIG. 12 is initiated, at first, the control unit 20 obtains the content of the attribute management data 23*c* in step S31. More specifically, first, the divided movie used for reproduction at the moment on the pusher game area 31*a* is specified. Then, the control unit 20 obtains the information of each record corresponding to the specified divided movie from the attribute management data 23*c*.

Subsequently, in step S32, the control unit 20 determines a prize based on the attribute management data 23*c* obtained in step S31. This determination is performed, for example, as follows. First, the control unit 20 specifies each hole 37 where the object 39 reaches based on the attribute management data 23*c*. Then, the control unit 20 determines whether or not the win attribute is assigned to each specified hole 37. If the result of the determination is negative, that is, if the win attribute is not assigned to any hole 37 where the object 39 reaches, the control unit 20 determines done not win a prize. Otherwise, if the win attribute is assigned to the hole 37 where the object 39 reaches, the control unit 20 determines whether the attribute corresponds to the win attribute or the big win attribute. If the attribute corresponds to the win attribute, the control unit 20 determines that a normal prize is won. Otherwise, if the attribute corresponds to the big win attribute, the control unit 20 determines that a special prize is won. In this case, the control unit 20 specifies the type of the special prize depending on the type of the object 39. The type of the special prize is specified, for example, as a first special prize when the shape of the object 39 is the crown 39*a*, as a second special prize in the case of the bear 39*b*, as a third special prize in the case of the diamond 39*c*, and as a fourth special prize in the case of the special coin 39*d*. The control unit 20 determines the prize by executing these processes for each hole 37 where the object 39 reaches.

Then, in step S33, the control unit 20 stores the result of the prize determination of step S32. Then, the control unit 20 terminates the prize determining routine, and returns to the routine of FIG. 10. Then, in step S16 of FIG. 10, whether or not there is a prize is determined based on the determination result stored in step S33 of FIG. 12, and a dividend is provided depending on the type of the prize in step S34. In addition, for example, the first special prize is associated with "$800" of FIG. 7, the second special prize is associated with "$100" of FIG. 7, the third special prize is associated with "$10" of FIG. 7, and the fourth special prize is associated with "$5" of FIG. 7.

As described above, according to the present embodiment, the win attribute of each hole 37 where the object 39 reaches in the movie is determined depending on the lottery. Therefore, it is possible to use the same movie where the object 39 reaches the same hole 37 for different lottery results. For this reason, the same result is not necessarily obtained even if the same movie is used. That is, using the same movie, it is possible to provide the result which is different from a result assumed by a player. For this reason, it is not necessary to prepare types of the movies depending on the types of the lottery results. As a result, it is possible to reduce costs such as a storage capacity for storing the movies or the like since it is possible to reduce the number of the movie types necessary for notifying the lottery result.

According to the embodiment described above, the control unit 20 serves as the position specifying device and the attribute assigning device by executing the process of step S23 of FIG. 11, and serves as the assigned attribute notification device by executing the routine of FIG. 11. Also, the control unit 20 serves as the attribute lottery device by executing the routine of FIG. 10 and serves as the change generating device by executing the process of step S17 of FIG. 10. Furthermore, the control unit 20 serves as the symbol lottery device by executing the process of step S11 of FIG. 10 and serves as the symbol attribute determination device by executing the process of step S22 of FIG. 11. And, the control unit 20 serves as the movie display device through the movie reproduction unit 30 and the process of step S18 of FIG. 10.

According to the embodiment described above, the external storage device 21 serves as the attribute management data storage device and the reaching position data storage device by storing the attribute management data 23*c*. Also, the external storage device 21 also serves as the movie data storage device by storing the movie data 23*b*.

The invention may be embodied in other suitable forms without limiting to the aforementioned embodiments. Although the attribute management data 23*c* serves as the reaching position data by containing information of the reaching positions in the aforementioned embodiment, the invention is not limited to such an embodiment. For example, data obtained by removing information of the attribute of the hole from the attribute management data 23*c* may be separately prepared as the reaching position data. In this case, for determining the prize, the attribute management data 23*c* may be created temporarily. Also, for example, a table (not shown) used to associate each symbol 42 and the win attribute with each other may serve as the attribute management data of the present invention.

Also, in accordance with the drop of the object 37 into the hole 37, a presentation of the win may be executed. For example, as the presentation, the hole 37 where the object 37 drops may be displayed so as to be more emphasized than other holes 37 by shining the hole 37 or the like. For example, the emphasis like this may be realized by switching the image of the symbol 42 displayed on the label portion 43 of the hole 37 where the object 37 drops to a shining image, or the like. The control unit 20 serves as a position display change device by generating change like this on the determination position. Also, in order to specify the moment of the drop of the object 37 into the hole 37, for example, a moment that frames (images) for representing the drop included in each movie are used may be managed. Or, elapsing time from a start of the movie to the drop of the object may be managed for each movie.

In the aforementioned embodiment, there is used the movie that objects reaches holes 37, and there is generated the one big win based on the movie. However, the present invention is not limited to this embodiment. For example, a plurality of the big wins may be generated based on the movie. Or, as the movie, there may be used a movie that one object reaches any one of holes. Also, a movie that one object reaches one hole may be used. And further, a movie that one object reaches a plurality of reaching positions may be used.

In the aforementioned embodiment, there is used each divided movie as the movie displayed on the slot game area 31*b*. Also, a content of each divided movie, that is, a content such as the movie 001, the movie 002 or the like do not change as far as each divided movie are reproduced based on the same data. That is, movement paths of the object 37 in each divided movie, drop positions, or the like do not change as far as the same data are used. However, the movie on the slot game area 31*b* is not limited to like this movie that the content reproduced based on the movie data does not change. For example, as the movie, there may be used a movie that a position in which a image should be arranged changes based on various conditions and the image moves by change of the position in accordance with elapsing time. The position of the image may be calculated at a predetermined frequency based on the various conditions. That is, as the movie, there may be used a movie that a content such as a movement path of the object, a reaching position, or the like changes. In this case, the player is more difficult to assume a result since the relationship between the content of the movie and lottery result since the relationship is decrease even further. For this reason, the fun of the game can be further improved.

Although the type of the symbol 42 is selected by lottery in the aforementioned embodiment, the lottery is not limited to such an embodiment. For example, one of a plurality of types of attributes may be directly selected by lottery. Also, the game executed in the pusher game area 31*a* is not limited to the pusher game. Similarly, the movie used in the pusher game area 31*a* is not limited to the pusher game. That is, any game may be used as the bonus game if the game uses the movie where the object moves.

Also, in the slot game area 31*b*, the executed game is not limited to the slot game. Any other games such as a card game or the like may be executed. Therefore, the condition for executing the bonus game routine may also be applied in the card game or the like. Furthermore, the bonus game routine is not limited to the embodiment that the game is executed as a bonus of other games. For example, the bonus game routine may be solely executed as an exchange of the consumption of the game value.

Although the attribute of the reaching position is notified to a player by displaying the symbol 42 corresponding to the attribute in each label portion 43 corresponding to each hole 37 in the aforementioned embodiment, the notification is not limited to such an embodiment. For example, the attributes of each reaching position may be notified by sound, or information of the attributes may be directly notified. Also, they may be notified using a list containing attributes of each reaching position.

Although the attribute such as a big win, a win, or a lose is used in the aforementioned embodiment, the attribute is not limited to such embodiment. For example, various other attributes may be used such as a free-game (a game that can be played without consuming the game value), assigning a high dividend in a main game, or assigning a separate game.

What is claimed is:

1. A game machine displaying a plurality of movies in which at least one object moves in a predetermined area, the game machine comprising:

a display device configured to display a virtual reel slot game and a pusher game, the pusher game being displayed using the plurality of movies with each of the plurality of movies including a pusher game sequence;

a control panel including an operation device that accepts operation by a player and an acceptor device which accepts physical media associated with a monetary value to establish a credit balance;

a movie data storage device that stores movie data for displaying the plurality of movies on the display;

a computer including a processor configured to execute a game program causing the processor to operate as:

a lottery unit configured to:

receive a signal from the control panel indicating a wager being placed by the player on a game, adjust the credit balance as a function of an amount of the wager, and initiate an instance of the virtual reel game; and initiate an instance of the pusher game upon detecting a triggering condition occurring during the virtual reel game;

an attribute management data storage device that stores attribute management data for managing a plurality of types of attributes;

a position specifying device configured to specify at least one determination position to be assigned with any one of the plurality of types of attributes in the predetermined area;

an attribute lottery device configured to select an attribute to be assigned to the determination position by lottery from a plurality of types of attributes;

an attribute assigning device configured to assign the attribute selected by the attribute lottery device to the determination position; and a movie display device configured to generate a predetermined sequence of the plurality of movies corresponding to the attribute selected by the attribute lottery device, and display the pusher game including the predetermined sequence of the plurality of movies on the display device.

2. The game machine according to claim 1, further comprising a reaching position data storage device that stores reaching position data for describing a reaching position of the object in the predetermined area on the plurality of movies, wherein the position specifying device specifies the reaching position as a determination position based on the reaching position data.

3. The game machine according to claim 2, wherein the determination position is displayed so that the determination position can be discriminated in the predetermined area from other portions of the predetermined area.

4. The game machine according to claim 3, further comprising an assigned attribute notification device configured to notify an attribute assigned to the determination position by the attribute assigning device to a player.

5. The game machine according to claim 3, wherein the attribute lottery device includes:

a symbol lottery device configured to select a symbol to be associated with the determination position by lottery from a plurality of symbols associated with each of a plurality of kinds of attributes; and a symbol attribute determination device configured to determine an attribute associated with the symbol selected by the symbol lottery device by lottery from a plurality of kinds of attributes, and the attribute lottery device is further configured to select at least one attribute by lottery from a plurality of kinds of the attributes in such a manner that the symbol attribute determination device determines an attribute to be assigned to the determination position based on the result of lottery of the symbol lottery device.

6. The game machine according to claim 3 wherein the movie data is configured such that the predetermined sequence of the plurality of movies has a same content whenever the predetermined sequence of the plurality of movies is displayed by the movie display device.

7. The game machine according to claim 1, wherein the determination position is displayed so that the determination position can be discriminated in the predetermined area from other portions of the predetermined area.

8. The game machine according to claim 7, wherein the program further causes the processor to operate as a change generating device configured to change a display of the determination position when the object reaches the determination position.

9. The game machine according to claim 1, further comprising an assigned attribute notification device configured to notify a player of an attribute assigned to the determination position by the attribute assigning device.

10. The game machine according to claim 9, wherein the assigned attribute notification device notifies the player of the attribute assigned to the determination position using a plurality of symbols associated with each of a plurality of kinds of attributes and displaying one of the symbols associated with the attribute assigned to the determination position to make a correlation between the symbol and the determination position.

11. The game machine according to claim 1, wherein the attribute lottery device includes:

a symbol lottery device configured to select a symbol to be associated with the determination position by lottery from a plurality of symbols associated with each of a plurality of kinds of attributes; and a symbol attribute determination device configured to determine an attribute associated with the symbol selected by the symbol lottery device by lottery from a plurality of kinds of attributes, and the attribute lottery device is configured to select at least one attribute by lottery from a plurality of kinds of the attributes in such a manner that the symbol attribute determination device determines an attribute to be assigned to the determination position based on the result of lottery of the symbol lottery device.

12. The game machine according to claim 11, further comprising an assigned attribute notification device configured to notify a player of the attribute assigned by the attribute assigning device to the determination position.

13. The game machine according to claim 12, wherein the assigned attribute notification device is further configured to use the plurality of symbols, and to notify the attribute assigned to the determination position to a player by displaying the symbol which is selected by the symbol drawing device by lottery so as to make a correlation between the symbol and the determination position.

14. The game machine according to claim 1, wherein the movie data is configured such that the predetermined sequence of the plurality of movies has a same content whenever the predetermined sequence of the plurality of movies is displayed by the movie display device.

15. The game machine according to claim 14, wherein the movie display device displays one of the plurality of movies based on the movie data and switches the one of the plurality of movies to another one of the plurality of movies in the predetermined sequence whenever a change is generated in the game.

16. The game machine according to claim 1, wherein the plurality of movies is configured to display a series of movies having continuity by being switched in the predetermined sequence.

17. The game machine according to claim 1, wherein the position specifying device is further configured to specify a plurality of determination positions as the at least one determination position.

18. The game machine according to claim 1, wherein the plurality of movies includes a plurality of objects as the at least one object.

19. A method of controlling a computer of a game machine displaying a plurality of movies with each movie including a pusher game sequence in which at least one object moves in a predetermined area and including a display device configured to display a virtual reel slot game and the pusher game, a control panel including an operation device that accepts operation by a player and an acceptor device which accepts physical media associated with a monetary value to establish a credit balance, a movie data storage device that stores movie data for displaying the plurality of movies, an attribute management data storage device that stores attribute management data for managing a plurality of types of attributes, and the computer includes a processor configured to execute a game program causing the processor to perform the method, wherein the method of controlling a computer of the game machine comprising the steps:

receiving a signal from the control panel indicating a wager being placed by the player on a game, adjusting the credit balance as a function of an amount of the wager, and initiating an instance of the virtual reel game;

initiating an instance of the pusher game upon detecting a triggering condition occurring during the virtual reel game;

specifying, by a position specifying device implemented by the control unit, at least one determination position to be assigned with any one of the plurality of types of attributes in the predetermined area;

selecting, by an attribute lottery device implemented by the control unit, an attribute to be assigned to the determination position by lottery from a plurality of types of attributes;

assigning, by an attribute assigning device implemented by the control unit, the attribute selected by the attribute lottery device to the determination position; and generating, by a movie display device, a predetermined sequence of the plurality of movies corresponding to the attribute selected by the attribute lottery device, and displaying the pusher game including the predetermined sequence of the plurality of movies on the display device.

20. A non-transitory computer readable medium recording a computer program for a game machine displaying a plurality of movies with each of the plurality of movies including a pusher game sequence in which at least one object moves in a predetermined area and including a display device configured to display a virtual reel slot game and the pusher game, a control panel including an operation device that accepts operation by a player and an acceptor device which accepts physical media associated with a monetary value to establish a credit balance, a movie data storage device that stores movie data for displaying the plurality of movies, and an attribute management data storage device that stores attribute management data for managing a plurality of types of attributes, the computer program being configured to make a computer of the game machine serve as:

a lottery unit configured to:

receive a signal from the control panel indicating a wager being placed by the player on a game, adjust the credit balance as a function of an amount of the wager, and initiate an instance of the virtual reel game; and initiate an instance of the pusher game upon detecting a triggering condition occurring during the virtual reel game;

a position specifying device configured to specify at least one determination position to be assigned with any one of the plurality of types of attributes in the predetermined area;

an attribute lottery device configured to select an attribute to be assigned to the determination position by lottery from a plurality of types of attributes;

an attribute assigning device configured to assign the attribute selected by the attribute lottery device to the determination position; and a movie display device configured to display a predetermined sequence of the plurality of movies corresponding to the attribute selected by the attribute lottery device.

* * * * *